US008607727B2

(12) United States Patent
Ballestrazzi et al.

(10) Patent No.: US 8,607,727 B2
(45) Date of Patent: Dec. 17, 2013

(54) ASSEMBLY FOR APPLYING A FLUID BEHAVIOUR SUBSTANCE, IN PARTICULAR FOR ENVELOPES OF LETTERS PROVIDED WITH A CLOSURE STRIP

(75) Inventors: Aris Ballestrazzi, Savignano Sul Panaro (IT); Lamberto Tassi, Savignano Sul Panaro (IT)

(73) Assignee: Sitma S.p.A., Spilamberto (Modena) (IT)

( * ) Notice: Subject to any disclaimer, the term of this patent is extended or adjusted under 35 U.S.C. 154(b) by 1121 days.

(21) Appl. No.: 12/150,869

(22) Filed: May 1, 2008

(65) Prior Publication Data

US 2008/0295767 A1 Dec. 4, 2008

(30) Foreign Application Priority Data

May 8, 2007 (IT) ..... MI2007A0929

(51) Int. Cl.
*B05C 1/00* (2006.01)
*B05C 11/02* (2006.01)
*B43M 3/00* (2006.01)

(52) U.S. Cl.
USPC ..... 118/211; 118/244; 118/212; 118/111; 156/441.5

(58) Field of Classification Search
USPC ..... 118/244, 258, 261; 156/64, 356, 357; 427/299
See application file for complete search history.

(56) References Cited

U.S. PATENT DOCUMENTS 426,728 A * 4/1890 Maret ..... 156/441.5
1,027,204 A * 5/1912 Hammond ..... 118/253
1,498,438 A * 6/1924 Dorn ..... 156/442.1
1,846,969 A * 2/1932 Kalenoff ..... 156/442.4
1,924,580 A * 8/1933 Watkins ..... 156/107
1,930,749 A * 10/1933 Haff ..... 118/311
1,957,827 A * 5/1934 Azel ..... 118/236
1,987,813 A * 1/1935 Allen ..... 118/32
2,243,536 A * 5/1941 Rouan et al. ..... 137/118.01
2,504,773 A * 4/1950 Williams ..... 118/100
2,572,513 A * 10/1951 Paul ..... 118/223

(Continued)

FOREIGN PATENT DOCUMENTS

JP 54-071700 A 6/1979

OTHER PUBLICATIONS

European Search Report Dated May 29, 2012.

*Primary Examiner* — Dah-Wei Yuan
*Assistant Examiner* — Karl Kurple
(74) *Attorney, Agent, or Firm* — Hedman & Costigan, P.C.; James V. Costigan; Kathleen A. Costigan

(57) ABSTRACT

An assembly (10) for applying a fluid behavior substance on a shaped closure strip (13, 13', 13") of an envelope (12, 12', 12") for letters comprising a supplying device (14) of the fluid behavior substance, a container element (17) of the fluid behavior substance supplied, a first and a second cylindrical element (18, 19) rotating around their parallel axis and radially arranged facing each other to form a passage for the envelope (12, 12', 12"), wherein the supplying device (14) comprises a vessel element (15) of the fluid behavior substance and a connection element (16) for the passage of the fluid behavior substance from the vessel element (15) into the container element (17), the second cylindrical element (19) comprises a side surface (21, 21', 21") partially shaped in a manner complementary with the shaped closure strip (13, 13', 13"), partially accommodated in the lower part of the container element (17) in contact with fluid behavior substance supplied.

5 Claims, 2 Drawing Sheets

(56) References Cited

U.S. PATENT DOCUMENTS

Figure 4:
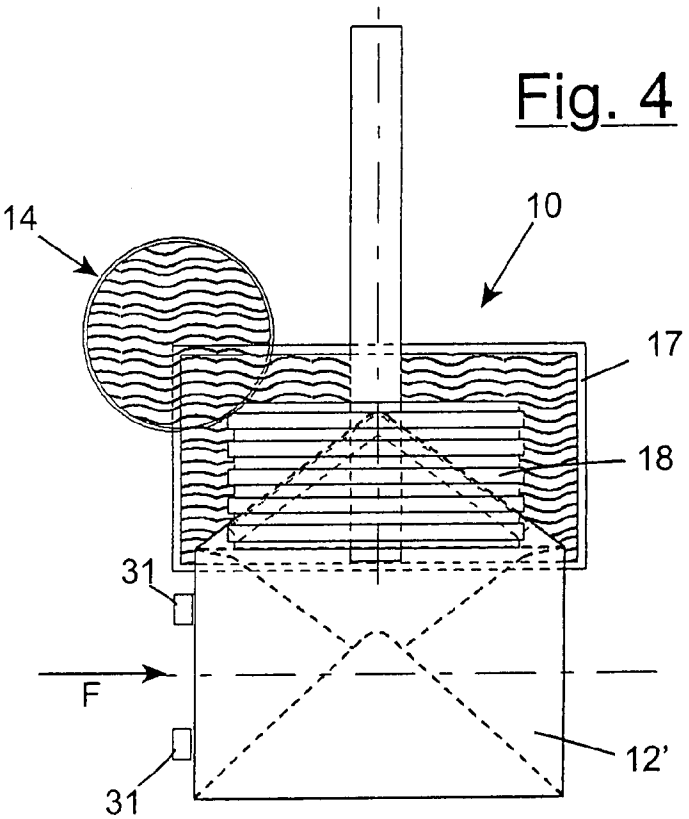

| | | | | | |
|---|---|---|---|---|---|
| 2,690,119 | A | * | 9/1954 | Black | 101/148 |
| 2,721,534 | A | * | 10/1955 | Lucas | 118/255 |
| 3,060,888 | A | | 10/1962 | Nifontoff | |
| 3,585,966 | A | * | 6/1971 | Hill | 118/262 |
| 3,965,851 | A | | 6/1976 | Cohn | |
| 4,188,414 | A | * | 2/1980 | Cohn | 427/541 |
| 4,207,832 | A | * | 6/1980 | Bowman et al. | 118/212 |
| 4,287,827 | A | * | 9/1981 | Warner | 101/141 |
| 4,370,942 | A | * | 2/1983 | Dowding et al. | 118/40 |
| 4,428,794 | A | * | 1/1984 | Hayskar et al. | 156/442.1 |
| 4,450,037 | A | * | 5/1984 | Gavronsky | 156/441.5 |
| 4,742,699 | A | * | 5/1988 | Nakahara et al. | 68/203 |
| 4,926,787 | A | * | 5/1990 | Fassman et al. | 118/32 |
| 5,006,194 | A | * | 4/1991 | Schmaling | 156/442.1 |
| 5,015,500 | A | * | 5/1991 | Garde | 427/211 |
| 5,028,457 | A | * | 7/1991 | Kinose et al. | 427/258 |
| 5,113,760 | A | * | 5/1992 | Sonobe et al. | 101/348 |
| 5,336,319 | A | * | 8/1994 | Narang et al. | 118/211 |
| 5,354,407 | A | * | 10/1994 | Hubbard et al. | 156/442.1 |
| 5,569,327 | A | * | 10/1996 | Paradis et al. | 118/253 |
| 5,633,045 | A | * | 5/1997 | Smith et al. | 427/428.17 |
| 5,922,406 | A | * | 7/1999 | Ludford, III | 427/287 |
| 6,176,180 | B1 | * | 1/2001 | Taylor et al. | 101/148 |
| 6,199,404 | B1 | * | 3/2001 | Kawai et al. | 65/102 |
| 6,296,898 | B1 | * | 10/2001 | Ito | 427/130 |
| 6,346,147 | B1 | * | 2/2002 | Rinehart et al. | 118/211 |
| 6,464,785 | B1 | * | 10/2002 | Puffe | 118/301 |
| 6,783,594 | B2 | * | 8/2004 | Fairweather et al. | 118/264 |
| 7,364,621 | B2 | * | 4/2008 | Defosse et al. | 118/264 |
| 7,732,036 | B2 | * | 6/2010 | Etchells | 428/76 |
| 8,006,635 | B2 | * | 8/2011 | Claris | 118/264 |
| 8,122,845 | B2 | * | 2/2012 | Feijen | 118/263 |
| 2002/0114889 | A1 | * | 8/2002 | VerMehren | 427/348 |
| 2003/0015818 | A1 | * | 1/2003 | Magvire | 264/140 |
| 2008/0156212 | A1 | * | 7/2008 | Yamada et al. | 101/375 |
| 2008/0156258 | A1 | * | 7/2008 | Claris | 118/264 |
| 2008/0163981 | A1 | * | 7/2008 | Claris | 156/442.2 |
| 2009/0252870 | A1 | * | 10/2009 | Munneke | 427/207.1 |

* cited by examiner

Fig. 3a
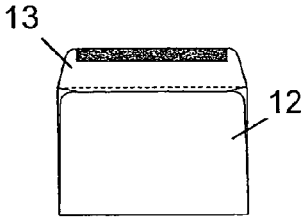
Fig. 3b
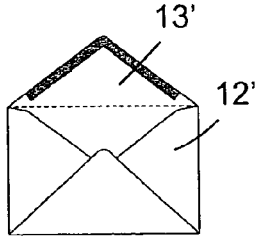
Fig. 3c
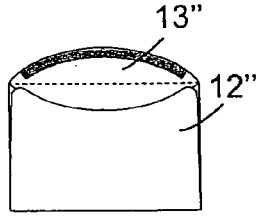
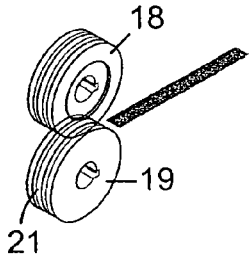
Fig. 2a
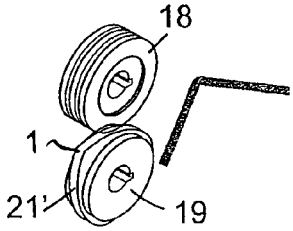
Fig. 2b
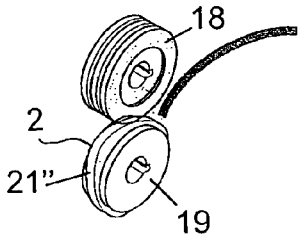
Fig. 2c
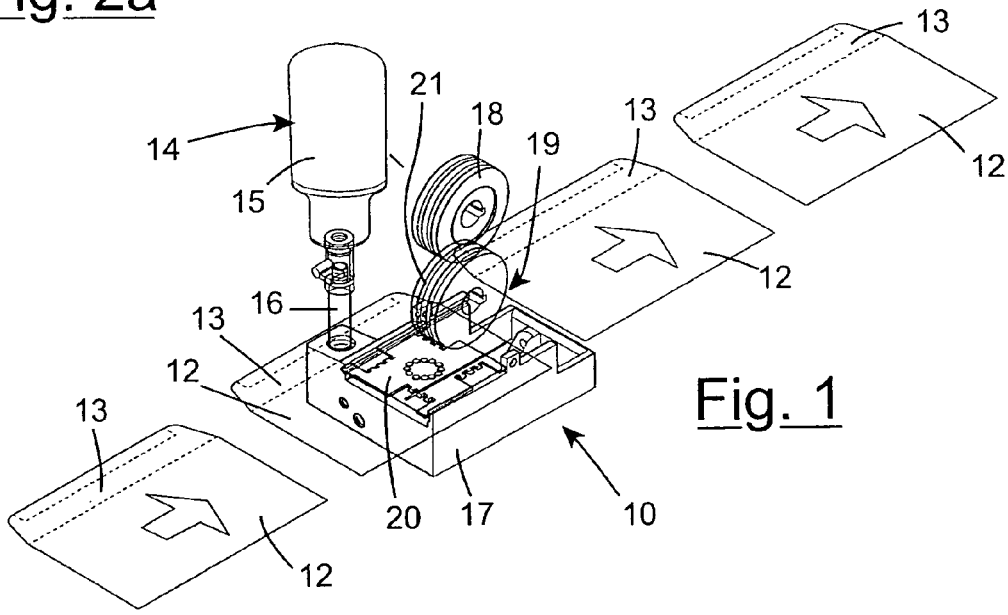
Fig. 1

ASSEMBLY FOR APPLYING A FLUID BEHAVIOUR SUBSTANCE, IN PARTICULAR FOR ENVELOPES OF LETTERS PROVIDED WITH A CLOSURE STRIP

The present invention refers to an improved assembly for applying a fluid in particular for envelopes of letters provided with a closure strip. Currently, various types of letter envelopes provided with a closure strip extremely different geometrically are widely available and used.

For example, reference can be made to the geometry of the closure strip of such envelopes which can be rectilinear, triangular, elliptic, etc.

In particular, currently, in order to guarantee a firm closure of the envelopes themselves, it is provided for that a fluid substance, such as generally an adhesive substance or any other substance, for example common water, in case the strip already comprises portions provided with an adhesive substance which can be moisture activated, be applied on the peripheral surface of such closure slip.

The purpose of said fluid substance is that of safely sealing the strip itself against the rest of the envelope and thus providing its protection against unauthorised and/or inadvertent opening.

However, currently there are no automated devices allowing an ideal application of the fluid substance on the abovementioned closure strips, often leading to waste of the substance itself.

Furthermore, presently there are no automated devices capable of allowing an ideal application of the fluid substance on all the currently existing types, different geometrically, of closure strips for letter envelopes.

The objective of the present invention is that of providing for a device capable of overcoming the abovementioned drawbacks of the known art in an extremely simple, inexpensive and particularly functional manner.

Another objective is that of providing an improved assembly for applying a fluid substance, in particular for letter envelopes provided with a closure strip, avoiding waste of the fluid behaviour substance.

Still, another objective is to provide for an improved assembly for applying a fluid substance, in particular for letter envelopes provided with a closure strip, capable of applying the aforementioned fluid substance on all the geometric types of letter envelopes closure strips available as of date.

These objectives according to the present invention are attained by providing an improved assembly for applying a fluid substance, in particular for letter envelopes provided with a closure strip, as described in claim 1.

Further characteristics of the invention are outlined by the subsequent claims.

Figure 5:
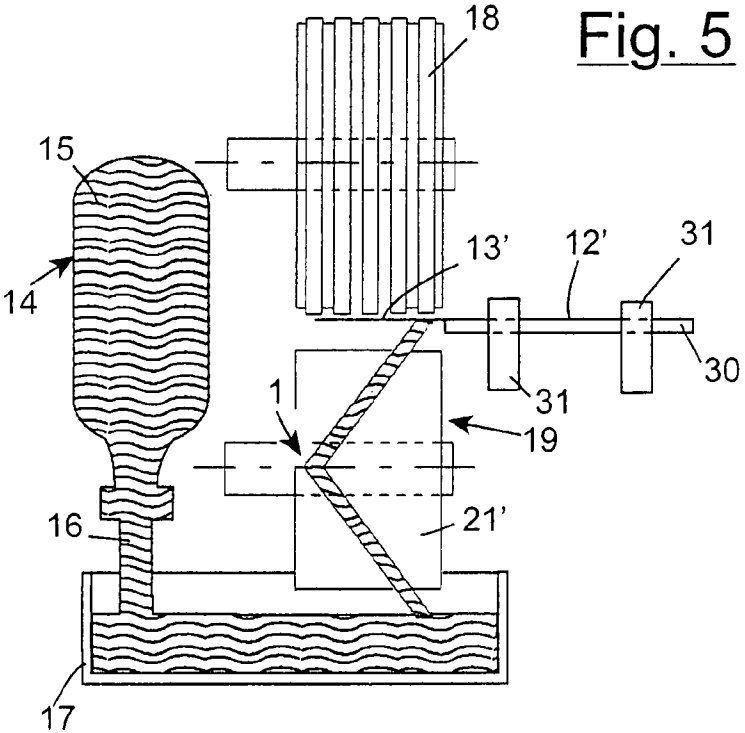

Characteristics and advantages of an improved assembly for applying a fluid substance, in particular for letter envelopes provided with a closure strip, according to the present invention shall be clearer from the following, exemplifying and non-limiting, description with reference to the attached schematic drawings wherein:

FIG. 1 is a schematic perspective view of an improved assembly for applying a fluid substance, in particular for letter envelopes provided with a closure strip, according to the present invention;

FIGS. 2*a*-2*c* are schematic perspective views of different embodiments of components of improved assemblies for applying a fluid substance, in particular for letter envelopes provided with a closure strip, according to the present invention;

FIGS. 3*a*-3*c* are schematic top views of letter envelopes provided with shaped closure strips sealable by means of an improved assembly for applying a fluid substance according to the present invention provided with the components of FIGS. 2*a*-2*c* respectively;

FIG. 4 is a partial sectional schematic top view of another improved assembly for applying a fluid substance, in particular letter envelopes provided with closure strips, according to the present invention; and FIG. 5 is a view of the improved assembly for applying a fluid substance, in particular letter envelopes provided with closure strips, of FIG. 4 according to arrow F.

Referring to FIGS. 1, 3 and 5, shown is an improved assembly 10 for applying a fluid substance for letter envelopes 12, 12', 12" provided with a closure strip 13, 13', 13".

The terms "fluid substance" mean a general adhesive substance or any other substance, for example common water, capable of activating an adhesive substance previously applied on the closure strip 13, 13', 13".

As observable in FIGS. 3*a*-3*c* the closure strips 13, 13', 13", are shaped and can be can generally be of any geometric type.

In order to allow such application of the fluid substance on the shaped closure strip 13, 13', 13" of the letter envelope 12, 12', 12", the assembly 10, referring to FIGS. 1, 3 and 5, comprises a supplying device 14 for the fluid behaviour substance, a container element 17 for the same fluid substance upon supply, a first and a second cylindrical element 18 and 19, both rotating around their parallel axes.

According to the invention, the assembly 10 can also comprise a scraper element 20, shown only in FIG. 1, in side contact with the second cylindrical element 19.

In particular, the first and a second cylindrical element 18 and 19 are arranged radially facing each other to form a calendar structure for the passage of the envelope 12, 12', 12", as shown in FIGS. 4 and 5, and the supplying device 14 comprises a vessel element 15 for the fluid substance and a connection element 16 for the passage of the same up to the container element 17.

Furthermore, according to the invention the second cylindrical element 19, provided with an at least partially shaped side surface 21, 21', 21", shown in FIGS. 2*a*-2*c* and 5, is arranged in such a manner that the latter is partially accommodated on the lower part of the container element 17, which is thus partially open on the upper part, ending up in contact with the fluid substance supplied contained therein.

As observable according to a preferred embodiment shown in FIG. 5, the side surface 21, 21', 21", preferably gets in contact with the fluid substance only with its at least partially shaped-part.

The scraper element 20, if provided, will act laterally in contact with side surface 21, 21', 21", during the rotation of the second cylindrical element 19.

As observable in FIGS. 2*a*-3*c* the side surface 21, 21', 21" can be partially shaped in a different manner depending on the requirements.

In particular, such side surface 21, 21', 21" is partially shaped in a manner complementary with the shaped closure strip 13, 13', 13" of the letter envelope 12, 12', 12" on which the fluid substance is intended to be applied.

As mentioned beforehand, the scraper element 20, if present, is in contact with the side surface 21, 21', 21" of the second cylindrical element 19 and, in particular, it can be provided for that such contact portion also be shaped in a manner complementary with the side surface 21, 21', 21", in turn partially shaped in a manner complementary with the shaped closure strip 13, 13', 13" of the letter envelope 12, 12', 12".

Furthermore, as observable in the schematic example of FIG. 1, such scraper element 20 can comprise several surfaces, possibly shaped in a manner complementary with the side surface 21, 21', 21", of which only one at a time operates against the second cylindrical element 19.

Additionally, it is advantageously possible for the scraper element 20 to be moveable, for example rotating around a central pin for connection with the container 17, selectively placing one of its surfaces in contact with the side surface 21, 21', 21". Regarding the at least partially shaped part of the side surface 21, 21', 21" of the second cylindrical element 19, such shaped part can be as general as possible as long as it is complementary with shaped strip 13, 13', 13" on which the fluid substance is intended to be applied.

Following are examples three different possible embodiments of the present invention.

The first embodiment, shown in FIG. 2*a*, refers to an assembly 10 for applying a fluid substance on a strip 13 with a rectilinear profile, of a letter envelope 12, very common and known currently.

In particular, in order to apply the fluid substance in a manner such to match the geometry of the abovementioned strip 13, the assembly 10 comprises a second cylindrical element 19 provided with a side surface 21 partially shaped with at least one projecting circular annular profile.

Such projecting circular annular profile is shown in perspective in FIG. 2*a*.

In this embodiment the side surface 21, and in particular advantageously only the at least one projecting circular annular profile, when rotating withholds part of the fluid substance supplied held in the container element 17.

The surplus part of the fluid substance is possibly re-introduced into the container element 17 by the scraper element 20.

At such point the envelope 12, and in particular the rectilinear strip 13, is passed, in a rectilinear manner, through the calendar arrangement of the two rotating cylindrical elements 18 and 19.

During this passage the strip 13 gets in contact with one side with the projecting circular annular profile of the side surface 21 which, bearing the fluid substance, deposits part of it on the relative strip 13.

Given that the shaped part of the strip 13 and the projecting circular annular profile of the side surface 21 are complementary, proper positioning of the fluid substance along the rectilinear profile of the strip 13 itself is guaranteed and applied only over the length required.

The same principle, with the due differences, is also valid for the embodiment shown in FIG. 2*b* which refers to an assembly 10 for applying a fluid substance on a strip 13' with a triangular profile of a letter envelope 12'.

Such assembly is also shown in FIGS. 4 and 5.

In particular, in order to apply a fluid substance in a manner such to match the geometry of the abovementioned strip 13', the assembly 10 comprises a second cylindrical element 19 provided with a side surface 21' partially shaped with at least one projecting triangular profile 1 shown in FIG. 5 and in perspective in FIG. 2*b*.

In such embodiment the side surface 21', and in particular advantageously only the at least one projecting triangular profile 1, when rotating withholds part of the fluid substance supplied held in the container element 17.

As mentioned beforehand, the surplus part of the fluid substance is possibly re-introduced into the container element 17 by the scraper element 20.

At such point the envelope 12', and in particular the triangular strip 13', is passed, in a rectilinear manner, through the calendar arrangement of the two rotating cylindrical elements 18 and 19.

Hence, during the passage the strip gets in contact with one side with the projecting triangular profile of the side surface 21' which, bearing the fluid substance, deposits part of it on the relative strip 13'.

Given that the shaped part of the strip 13' and of the side surface 21' are complementary, proper positioning of the fluid substance along the triangular profile of the strip 13' itself is guaranteed without the fluid substance leaking from the envelope.

A further embodiment is shown in FIG. 2*c*, which refers to an assembly 10 for applying a fluid substance on a letter envelope 12" strip 13" with an elliptic profile.

In particular, in order to apply a fluid substance in a manner such to match the geometry of the abovementioned strip 13", the assembly 10 comprises a second cylindrical element 19 provided with a side surface 21" partially shaped with at least one projecting elliptic profile 2 shown in perspective in FIG. 2*c*.

In such embodiment the side surface 21", and in particular advantageously only the at least one projecting elliptic profile 2, when rotating withholds part of the fluid substance supplied held in the container element 17.

The surplus part of the fluid substance is possibly re-introduced into the container element 17 by the scraper element 20.

At such point the envelope 12", and in particular the elliptic strip 13", is passed, in a rectilinear manner, through the calendar arrangement of the two rotating cylindrical elements 18 and 19 hence, getting in contact with one side with the projecting elliptic profile of the side surface 21" which, bearing the fluid substance, deposits part of it on the relative strip 13".

Given that the shaped parts of the strip 13" and of the side surface 21" are complementary, proper positioning of the fluid substance along the elliptical profile of the strip 13" itself is guaranteed.

Additionally, the invention provides for that at least one between the first and the second cylindrical element 18 or 19 be rotated by motorised actuator means, not shown.

Lastly, it is provided that the assembly 10 further comprises at least one conveyor 30, possibly provided with at least one pushing device 31 for aligning the abovementioned envelopes 12, 12', 12", adapted to deliver and transport the abovementioned envelopes 12, 12', 12" upstream, at and downstream the calendar arrangement formed by the two cylindrical elements 18 and 19 in such a manner that the strip 13, 13', 13" passes in contact with the side surface 21, 21', 21" of the cylindrical element 19 provided with at least one projecting shaped profile bearing the fluid substance as shown in FIG. 5.

The operation of the device subject of the finding is very easy to understand.

The assembly 10 comprises a container 17 for a fluid substance, supplied by a supplying device 14, partially fitted into which is a side surface 21, 21', 21", provided with at least one shaped profile, preferably projecting, of a cylindrical element 19.

Such cylindrical element 19 rotates and when rotating it withholds, and in particular advantageously only on the projecting partial shaped part of its side surface 21, 21', 21", part of the fluid substance held in the container 17.

Possibly, the surplus part of the fluid substance collected by the side surface 21, 21', 21" is re-introduced into the container 17 by a scraper element 20 which operates on the side surface 21, 21', 21" itself.

In such manner waste of the fluid substance is avoided and additionally, being provided for that such scraper element 20 be moveable and provided with several sides, it shall be possible, once one side wears out, to see to repositioning of the scraper element 20 with another side without necessarily replacing the entire element.

By passing the envelope 12, 12', 12", and in particular the strip 13, 13', 13", through the calendar arrangement formed by the rotating cylindrical element 19 with another rotating cylindrical element 18 coupled to it, the envelope shall get-in contact with one side with the projecting shaped profile of the side surface 21, 21', 21" which, bearing the fluid substance it deposits part of it on the strip 13, 13', 13".

As mentioned beforehand such fluid substance can be a general adhesive substance or any other substance, such as for example common water, capable of activating the adhesive substance previously deposited on the strip 13, 13', 13".

According to the invention, given that the shaped parts of the strip 13, 13', 13" and of the side surface 21, 21', 21" are complementary, proper positioning of the fluid substance along the profile of the strip 13, 13', 13" is guaranteed, regardless of the type of strip.

In such manner, the assembly 10 is capable of overcoming the abovementioned drawbacks of the known art in an extremely simple, inexpensive and particularly functional manner.

In particular, the assembly 10 subject of the present invention thus guarantees avoiding waste of the fluid substance applying it in an ideal manner on all geometric types of letter envelop closure strips currently available.

Hence it has been observed that an improved assembly for applying a fluid behaviour substance, in particular for letter envelopes provided with a closure strip according to the present invention, attains all the objectives outlined above.

The improved assembly for applying a fluid substance, in particular for letter envelopes provided with a closure strip according to the present invention, thus conceived is susceptible to various modifications and variants, all of which fall within the same inventive concept; furthermore, all the details can be replaced by other technically equivalent elements. In practice, the materials used, alongside their dimensions, may vary depending on the technical requirements.

The invention claimed is:

1. Assembly (10) for applying a fluid substance on a shaped closure strip (13, 13', 13") of an envelope (12, 12', 12") for letters comprising a supplying device (14) of said fluid substance, a container element (17) of said fluid substance supplied, a first and a second cylindrical element (18, 19) each of said cylindrical elements having a cylindrical surface wherein said cylindrical elements rotate around axes which are parallel to one another wherein said axes are located one above the other and said cylindrical surfaces are arranged so that they face each other and form a passage for said envelope (12, 12', 12"), wherein said supplying device (14) comprises a vessel element (15) of said fluid substance and a connection element (16) for the passage of said fluid substance from said vessel element (15) into said container element (17), said second cylindrical element (19) comprises a side surface (21, 21', 21") partially shaped with at least one projecting annular profile where said projecting annular profile is partially accommodated in the lower part of said container element (17) and only said projecting annular profile is in contact with said fluid substance supplied in said supplying device (14), said side surface (21, 21', 21") additionally being partially shaped in a manner complementary with said shaped closure strip (13, 13', 13") wherein said side surface (21, 21', 21") is in contact with a moveable scraper element (20) laterally in contact with said side surface (21, 21', 21"), said scraper element being positioned and shaped in a manner complimentary to said side surface (21, 21', 21") so that said scraper element re-introduces surplus fluid substance to said container element (17).

2. Assembly (10) according to claim 1 characterised in that said scraper element (20) comprises four portions arranged on opposite sides and in that said scraper element (20) is moveable to selectively place one of said four portions selectively in contact with said side surface (21, 21', 21").

3. Assembly (10) according to claim 1 characterised in that said side surface (21') is partially shaped with at least one projecting triangular profile.

4. Assembly (10) according to claim 1 characterised in that said side surface (21") is partially shaped with at least one projecting elliptic profile.

5. Assembly (10) according to claim 1 further comprising at least one conveyor (30) of said letter envelopes (12, 12', 12").

* * * * *